US007862345B2

(12) United States Patent
Fukazawa et al.

(10) Patent No.: US 7,862,345 B2
(45) Date of Patent: Jan. 4, 2011

(54) ELECTRICAL CONNECTOR

(75) Inventors: Takeki Fukazawa, Tokyo (JP); Takanobu Yoshimi, Tokyo (JP)

(73) Assignee: DDK Ltd., Tokyo (JP)

( * ) Notice: Subject to any disclaimer, the term of this patent is extended or adjusted under 35 U.S.C. 154(b) by 96 days.

(21) Appl. No.: 12/407,123

(22) Filed: Mar. 19, 2009

(65) Prior Publication Data

US 2009/0239422 A1 Sep. 24, 2009

(30) Foreign Application Priority Data

Mar. 21, 2008 (JP) ..... 2008-072709

(51) Int. Cl.
*H01R 12/00* (2006.01)

(52) U.S. Cl. ..... 439/74

(58) Field of Classification Search ..... 439/74, 439/247, 248, 660, 876, 563
See application file for complete search history.

(56) References Cited

U.S. PATENT DOCUMENTS 5,201,663 A * 4/1993 Kikuchi et al. ..... 439/83
6,019,613 A * 2/2000 Kataoka et al. ..... 439/83
6,045,380 A * 4/2000 Hashimoto ..... 439/248
6,155,858 A * 12/2000 Ozawa et al. ..... 439/248
6,390,828 B1 * 5/2002 Yamaguchi et al. ..... 439/74
7,125,260 B2 * 10/2006 Orita et al. ..... 439/74
7,635,274 B2 * 12/2009 Fukazawa et al. ..... 439/247

FOREIGN PATENT DOCUMENTS

JP 2002-42937 2/2002
JP 2002-352908 12/2002
JP 2003-45525 2/2003

* cited by examiner

*Primary Examiner*—Alexander Gilman
(74) *Attorney, Agent, or Firm*—Dickstein Shapiro LLP

(57) ABSTRACT

An electrical connector consists of a plug connector and a receptacle connector to be fitted. An insulator is supported only by plug contacts each provided between second and third fixed portions with an elastic portion having at least one snaked portion so as to be floating in a housing. The shape of the second contact portion of each of the plug contacts is substantially in the form of a plate-shaped piece so that the second contact portion of the plug contact and the first contact portion of a receptacle contact are caused to contact each other in line contact at one location, and the elastic portion is arranged within a range from a position below the second contact portion to a position below the insulator. The electrical connector thus constructed is superior in resistance to vibration, and achieves space-saving and floating of the insulator.

5 Claims, 6 Drawing Sheets

ELECTRICAL CONNECTOR

BACKGROUND OF THE INVENTION

This invention relates to an electrical connector for use in electric and electronic appliances such as industrial machines, car navigation systems, and the like, and more particularly to an electrical connector superior in resistance to vibration and enabling floating of a part in the connector even when a space-saving is achieved (width dimension in a fitted state being less than 5 mm).

In hitherto used electrical connectors having a floating part, two insulators have often been used, either of which is supported only by contacts having an elastic portion which is elastically deformable. It has been found that in order to provide an elasticity to contacts, elastic portions of the contacts are snaked or curved, or the contacts are elongated by increasing a distance between two insulators.

As examples of prior art electrical connectors, incorporated herein are Japanese Patent Application Opened No. 2002-42,937 (Patent Literature 1), Japanese Patent Application Opened No. 2002-352,908 (Patent Literature 2) and Japanese Patent Application No. 2003-45,525 (Patent Literature 3), these being proposed by the applicant of the present case.

Patent Literature 1

According to the abstract of the Japanese Patent Application Opened No. 2002-42,937, this invention has an object to provide an electrical connector 1 enabling any defective connection to be prevented by avoiding contacts 14 and 24 from being loaded when substrates 60 are being fixed to a casing in the fitted state of a pin connector 10 and a socket connector 20. Disclosed is an electrical connector 1 consisting of a pin connector 10 and a socket connector 20 detachably fitted with each other, wherein a locator 40 having a groove 42 of a size for receiving the socket connector 20 is provided with engaging means adapted to engage the socket connector 20, and the socket connector 20 is mounted on the locator 40 and floatingly fixed to the substrate 60. Moreover, the socket connector 20 has a floating function by setting the length of socket contacts 24 within the locator 40 to 5 mm to 10 mm.

In connection with the above description, claim 1 of the Japanese Patent Application Opened No. 2002-42,937 recites an electrical connector consisting of a pin connector and a socket connector detachably fitted with each other, said pin connector comprising a required number of pin contacts and a block for holding and fixing said pin contacts, and said socket connector comprising a required number of socket contacts to contact said pin contacts and a housing for holding and fixing said socket contacts, wherein a locator having a groove of a size for receiving said socket connector is provided with engaging means adapted to engage said socket connector, and said socket connector is mounted on the locator and is floatingly fixed to a substrate. Claim 2 recites the electrical connector as claimed in claim 1, wherein the length of socket contacts within said locator is 5 to 10 mm to provide the floating function to the socket connector. Claim 3 recites the electrical connector as claimed in claim 1, wherein said locator is formed with grooves continuously provided so that the socket contacts of said socket connector are displaceable in said continuously provided grooves, thereby providing the floating function to the socket connector. Claim 4 recites the electrical connector as claimed in claim 2, wherein said socket contacts are bent or twisted substantially at right angles in the continuously provided grooves of said locator. Claim 5 recites the electrical connector as claimed in claim 2, wherein said socket contacts are curved in the continuously provided grooves of said locator.

Patent Literature 2

According to the abstract of Japanese Patent Application Opened No. 2002-352,908, the invention has an object to provide a connector 10, 40 which is of a floating construction and able to position connection portions of contacts with a simple construction without increasing the number of parts. Disclosed is a connector including contacts 14, 44 each having a contact portion 32 adapted to contact a mating contact, a fixed portion 34 to be fixed to a block 12, 42, and a connection portion 22 to be connected to a substrate, and the block 12, 42 for holding and fixing therein a required number of the contacts 14, 44, wherein the contacts 14, 44 each comprise an elastic portion 20, 50 between the fixed portion 34 and the connection portion 22, and a housing 16, 46 having a substantially box shape with a clearance relative to the outer dimension of the block 12, 42 is located on the side of the connection portions of the contacts 14, 44, thereby enabling the positioning of the connection portions 22 of the contacts relatively to the substrate and also enabling floating of the connector 10, 40. In order to facilitate the floating, preferably the elastic portion 20, 50 of each of the contacts 14, 44 has at least one snaked portion.

In connection with the above description, claim 1 of the Japanese Patent Application Opened No. 2002-352,908 recites a connector to be mounted on a substrate, including contacts each having a contact portion adapted to contact a mating connector, a fixed portion to be fixed to a block, and a connection portion to be connected to the substrate, and the block for holding and fixing a required number of the contacts, wherein the contacts each comprise an elastic portion between the fixed portion and the connection portion, and a housing is provided which has a substantially box shape with a clearance relative to the outer dimension of the block and located on the side of the connection portions of the contacts, thereby enabling the positioning of the connection portions of the contacts relatively to the substrate and also enabling floating of the connector. Claim 2 recites the connector as claimed in claim 1, wherein the elastic portion of each of contacts includes at least one snaked portion. Claim 3 recites the connector as claimed in claim 2, wherein a cross-shaped positioning portion is provided between the elastic portion and the connection portion of each of the contacts. Claim 4 recites the connector as claimed in claim 3, wherein the housing is provided with a required number of inserting grooves in the surface on the substrate connection side for inserting the contacts, between which inserting grooves there are provided plate-shaped members which are each provided with a protrusion on one side and a guide face on the other side, while an inclined face A and an inclined face B are provided contiguous to each of the guide faces, and an inclined portion is provided which is substantially perpendicular to and contiguous to the inclined face A. Claim 5 recites the connector as claimed in claim 4, wherein each of the contacts is installed into the housing by steps of first inserting the contact with the tip of the cross-shaped positioning portion along the guide face, then causing the tip to move along the inclined portion and the inclined face A toward the protrusion, further causing the tip to move along the inclined face B toward the protrusion, and causing the cross-shaped positioning portion to fall onto the protrusion and installed portion.

Patent Literature 3

According to the abstract of Japanese Patent Application Opened No. 2003-45,525, the invention has an object to provide a connector 10 which is of a floating construction and able to position connection portions 22 of contacts with a simple construction without increasing the number of parts. Disclosed is a connector 10 including contacts 14 each having a contact portion 32 adapted to contact a mating contact, a fixed portion 34 to be fixed to a block 12, and a connection portion 22 to be connected to a substrate, and the block 12 for holding and fixing therein a required number of the contacts 14, wherein the contacts 14 each comprise an elastic portion 20 having at least one snaked portion between the fixed portion 34 and the connection portion 22, and the block 12 is provided with a housing 16 having a substantially box shape with a clearance relative to the outer dimension of the block 12 and located on the side of the connection portions of the contacts 14, thereby enabling the positioning of the connection portions 22 of the contacts relatively to the substrate and also enabling floating of the connector 10. Moreover, the contacts 14 are each preferably provided between the elastic portion 20 and the connection portion 22 with a fitting portion 21 adapted to engage an inserting hole 36 of the housing 16.

In connection with the above description, claim 1 of the Japanese Patent Application Opened No. 2003-45,525 recites a connector to be mounted on a substrate, including contacts each having a contact portion adapted to contact a mating contact, a fixed portion to be fixed to a block, and a connection portion to be connected to the substrate, and the block for holding and fixing a required number of the contacts, wherein the contacts each comprise an elastic portion having at least one snaked portion between the fixed portion and the connection portion, and the block is provided with a housing having a substantially box shape with a clearance relative to the outer dimension of the block and located on the side of the connection portions of the contacts, thereby enabling the positioning of the connection portions of the contacts relatively to the substrate and enabling floating of the connector. Claim 2 recites the connector as claimed in claim 1, wherein the housing having arm portions is formed on both sides in width direction with slits adjacent to the arm portions to provide elasticity to the arm portions for facilitating mounting of locking portions of the block onto the arm portions. Claim 3 recites the connector as claimed in claim 2, wherein the contacts are each provided between the elastic portion and the connection portion with a fitting portion adapted to engage an inserting hole of the housing.

In recent years, a wide variety of technical requirements for electrical connectors from customers have been increased. Aside from a distance between substrates with fitted plug and receptacle connectors, there have been increasing demands for electrical connectors which achieve space-saving as much as possible when fitted (miniaturized width dimension), and are superior in resistance to vibration, while enabling floating of a part resulting in higher connection stability.

However, in order to achieve the space-saving (miniaturized width dimension), thicknesses of walls must be thinner as much as possible, while for the purpose of improving the resistance to vibration, the thicknesses of the walls must be thicker as much as possible so that the contradictory problems remain to be solved. In order to realize the floating of the part, contacts need to be snaked or curved to have an elasticity and two insulators need to be combined so that the width dimension becomes necessarily greater which is contrary to the space-saving.

The constructions of the Patent Literatures 1 to 3 could not fulfill all these requirements described above.

SUMMARY OF THE INVENTION

The invention has been achieved in view of these problems with the prior art described above, and the invention has an object to provide an electrical connector which is superior in resistance to vibration and enables space-saving and floating of part.

The object of the invention can be achieved by the electrical connector 10 consisting of a plug connector 50 and a receptacle connector 20 detachably fitted with each other, said receptacle connector 20 including a plurality of receptacle contacts 24 each having a first contact portion 26 adapted to contact a mating contact, a first fixed portion 28 to be fixed to a block 22, and a first connection portion 30 to be connected to a substrate 90, and the block 22 for arranging and holding said receptacle contacts 24, and said plug connector 50 including a plurality of plug contacts 56 each having a second contact portion 58 adapted to contact said receptacle contact 24, second and third fixed portions 60 and 62 to be fixed to a housing 52 and an insulator 54, respectively, and a second connection portion 64 to be connected to a substrate 90, and the housing 52 and the insulator 54 for arranging and holding said plug contacts 56, constructed according to the invention in that each of said plug contacts 56 is provided between said second and third fixed portions 60 and 62 with an elastic portion 66 having at least one snaked portion, and said insulator 54 is held in a floating state in said housing 52 by supporting the insulator 54 only by said pug contacts 56, that the shape of the second contact portion 58 of each of said plug contacts 56 is substantially in the form of a plate-shaped piece, and further the second contact portion 58 of each of said plug contacts 56 and the first contact portion 26 of each of said receptacle contacts 24 are caused to contact each other in line contact at one location, and that said elastic portion 66 of each of said plug contacts 56 is arranged within a range from a position below said second contact portion 58 on the side of the second connection portion 64 to a position below said insulator 54 on the side of the second connection portion 64.

The electrical connector 10 of claim 2 is so constructed that in the electrical connector as claimed in claim 1, said housing 52 is provided with a space 68 substantially in the form of a box in which said receptacle connector 20 is accommodated and said insulator 54 is capable of floating, and a width dimension of the fitted plug and receptacle connectors 50 and 20 is limited to 5 mm or less even if thicknesses of side walls 70 of said housing 52 are made to be as thick as possible to achieve improvement in resistance to vibration, while permitting the floating of the insulator 54.

The electrical connector 10 of claim 3 is so constructed that in the electrical connector as claimed in claim 1 or 2, said elastic portion 66 has only one snaked portion and two radii 72 of curvatures of said elastic portion 66 are 0.2 to 0.7 mm.

The electrical connector 10 of claim 4 is so constructed that in the electrical connector as claimed in any one of claims 1 to 3, each of said plug contacts 56 is provided between the elastic portion 66 and the third fixed portion 62 with a curved portion 74 which is folded inwardly onto the opposite side of the side wall 70.

As can be seen from the above descriptions, the electrical connector according to the invention can bring about the following significant functions and effects.

(1) An electrical connector claimed in claim 1 is the electrical connector 10 consisting of a plug connector 50 and a receptacle connector 20 detachably fitted with each other, said receptacle connector 20 including a plurality of receptacle contacts 24 each having a first contact portion 26 adapted to contact a mating contact, a first fixed portion 28 to be fixed to a block 22, and a first connection portion 30 to be connected to a substrate 90, and the block 22 for arranging and holding said receptacle contacts 24, and said plug connector 50 including a plurality of plug contacts 56 each having a second contact portion 58 adapted to contact said receptacle contact 24, second and third fixed portions 60 and 62 to be fixed to a housing 52 and an insulator 54, respectively, and a second connection portion 64 to be connected to a substrate 90, and the housing 52 and the insulator 54 for arranging and holding said plug contacts 56, wherein each of said plug contacts 56 is provided between said second and third fixed portions 60 and 62 with an elastic portion 66 having at least one snaked portion, and said insulator 54 is held in a floating state in said housing 52 by supporting the insulator 54 only by said pug contacts 56, wherein the shape of the second contact portion 58 of each of said plug contacts 56 is substantially in the form of a plate-shaped piece, and further the second contact portion 58 of each of said plug contacts 56 and the first contact portion 26 of each of said receptacle contacts 24 are caused to contact each other in line contact at one location, and wherein said elastic portion 66 of each of said plug contacts 56 is arranged within a range from a position below said second contact portion 58 on the side of the second connection portion 64 to a position below said insulator 54 on the side of the second connection portion 64. Accordingly, the electrical connector according to the invention achieves a saved space of 5 mm or less when fitted (3 mm smaller than those of the prior art) and the improvement in resistance to vibration (refer to Table 1), and further enables floating of part with movements of 0.2 to 0.5 mm. In other words, the invention provides the electrical connector 10 which can realize the floating of part, space-saving and a reduced overall height and is superior in vibration proof characteristics.

(2) According to the electrical connector 10 claimed in claim 2, said housing 52 is provided with a space 68 substantially in the form of a box in which said receptacle connector 20 is accommodated and said insulator 54 is capable of floating, and a width dimension of the fitted plug and receptacle connectors 50 and 20 is limited to 5 mm or less even if thicknesses of side walls 70 of said housing 52 are made to be as thick as possible to achieve improvement in resistance to vibration, while permitting the floating of the insulator 54. Therefore, the electrical connector according to the invention achieves a saved space of 5 mm or less when fitted (3 mm smaller than those of the prior art) and the improvement in vibration proof characteristics (refer to Table 1), and further enables floating of part with movements of 0.2 to 0.5 mm. In other words, the invention provides the electrical connector 10 which can realize the floating of part, space-saving and a reduced overall height and is superior in vibration proof characteristics.

(3) According to the electrical connector 10 claimed in claim 3, said elastic portion 66 has only one snaked portion and two radii 72 of curvatures of said elastic portion 66 are 0.2 to 0.7 mm. Consequently, the electrical connector according to the invention achieves an even more saved space of 5 mm or less when fitted (3 mm smaller than those of the prior art) and the improvement in resistance to vibration (refer to Table 1), and further enables floating of part with movements of 0.2 to 0.5 mm. In other words, the invention provides the electrical connector 10 which can realize the floating of part, space-saving and a reduced overall height and is superior in resistance to vibration.

(4) According to the electrical connector 10 claimed in claim 4, each of said plug contacts 56 is provided between the elastic portion 66 and the third fixed portion 62 with a curved portion 74 which is folded inwardly onto the opposite side of the side wall 70. Accordingly, the electrical connector according to the invention achieves an even more saved space of 5 mm or less when fitted (3 mm smaller than those of the prior art) and the improvement in resistance to vibration (refer to Table 1), and further enables floating of part with movements of 0.2 to 0.5 mm. In other words, the invention provides the electrical connector 10 which can realize the floating of part, space-saving and a reduced overall height and is superior in resistance to vibration.

The invention will be more fully understood by referring to the following detailed specification and claims taken in connection with the appended drawings.

DESCRIPTION OF THE PREFERRED EMBODIMENT

Figure 1A:
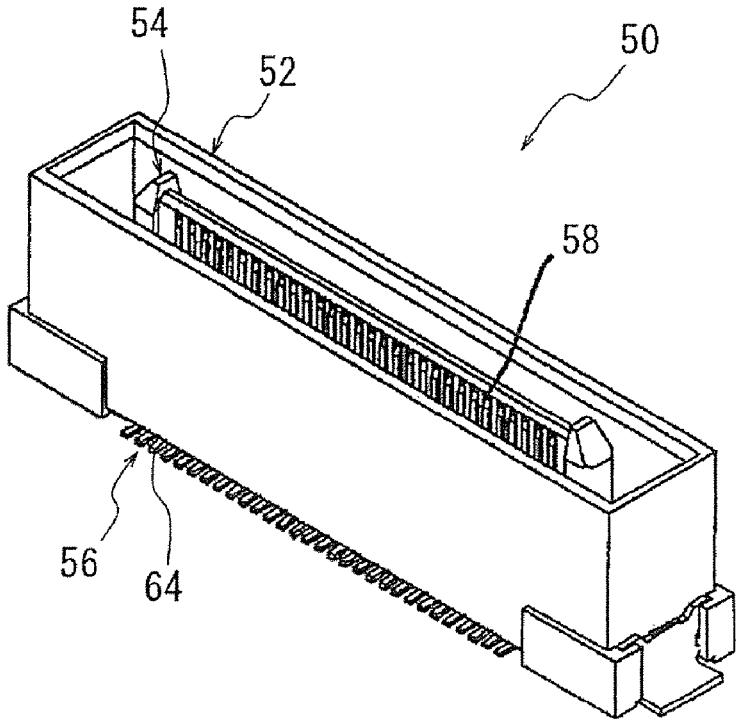
FIG. 1A is a perspective view of a plug connector of the electrical connector according to the invention viewed from the side of fitting with a receptacle connector.

The important aspect of the invention lies in the electrical connector 10 consisting of a plug connector 50 and a receptacle connector 20 detachably fitted with each other, said receptacle connector 20 including a plurality of receptacle contacts 24 each having a first contact portion 26 adapted to contact a mating contact, a first fixed portion 28 to be fixed to a block 22, and a first connection portion 30 to be connected to a substrate 90, and the block 22 for arranging and holding said receptacle contacts 24, and said plug connector 50 including a plurality of plug contacts 56 each having a second contact portion 58 adapted to contact said receptacle contact 24, second and third fixed portions 60 and 62 to be fixed to a housing 52 and an insulator 54, respectively, and a second connection portion 64 to be connected to a substrate 90, and the housing 52 and the insulator 54 for arranging and holding said plug contacts 56, wherein each of said plug contacts 56 is provided between said second and third fixed portions 60 and 62 with an elastic portion 66 having at least one snaked portion, and said insulator 54 is held in a floating state in said housing 52 by supporting the insulator 54 only by said pug contacts 56, wherein the shape of the second contact portion 58 of each of said plug contacts 56 is substantially in the form of a plate-shaped piece, and further the second contact portion 58 of each of said plug contacts 56 and the first contact portion 26 of each of said receptacle contacts 24 are caused to contact each other in line contact at one location, and wherein said elastic portion 66 of each of said plug contacts 56 is arranged within a range from a position below said second contact portion 58 on the side of the second connection portion 64 to a position below said insulator 54 on the side of the second connection portion 64.

That is to say, the insulator made of a plastic material of the plug connector 50 is divided into two parts, that is, the housing 52 and the insulator 54, and the insulator 54 is supported only by the plug contacts 56 each having the elastic portion 66, thereby enabling the insulator to be movable or to do floating. The elastic portion 66 of each of the plug contacts 56 is arranged from a position below said second contact portion 58 (on the side of the second connection portion 64) to a position below said insulator 54 (on the side of the second connection portion 64), thereby increasing the thicknesses of the walls of the housing 52 to improve a resistance to vibration, while maintaining the space-saving.

Figure 6B:
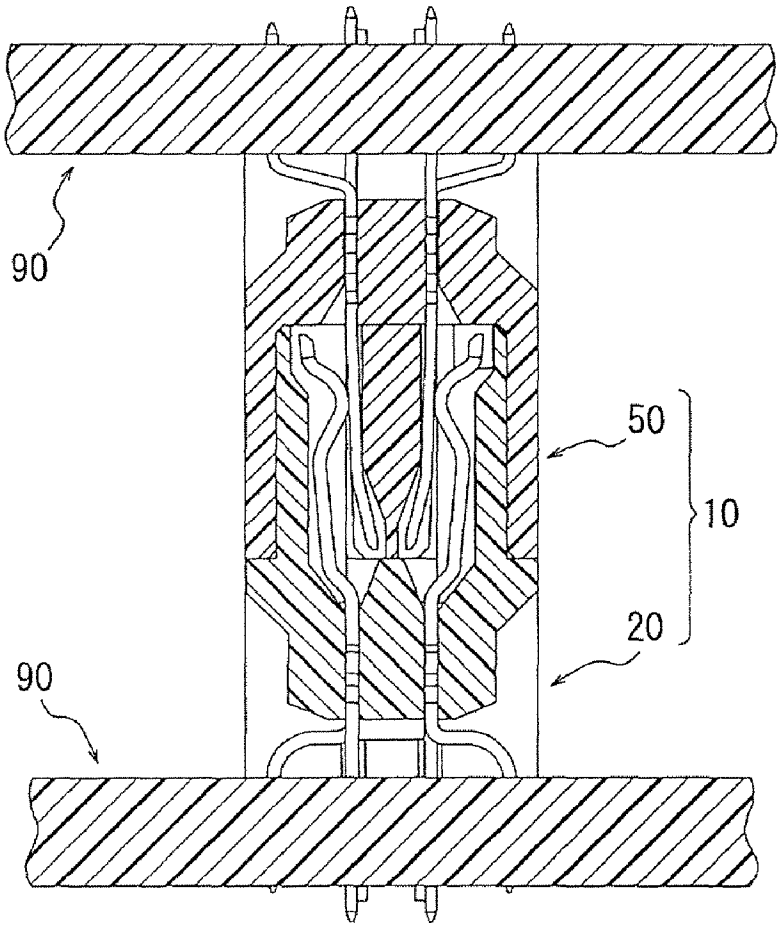
FIG. 6B PRIOR ART
FIG. 6B is a cross-sectional view of an electrical connector of the prior art No. 2 used in the test of which results are shown in Table 1.
Figure 6A:
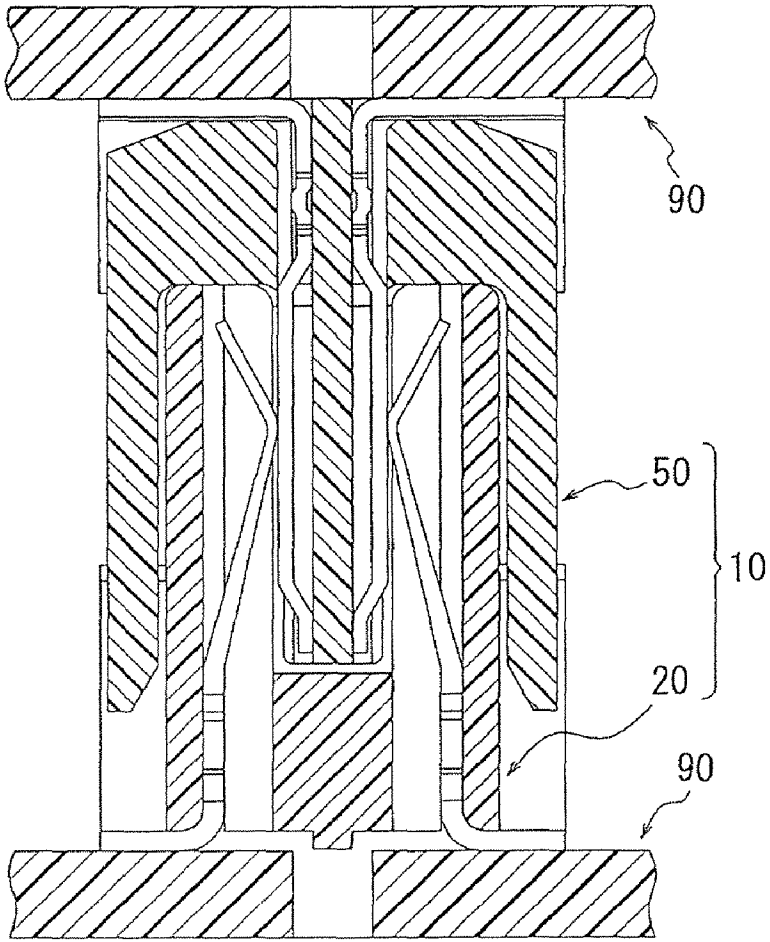
FIG. 6A PRIOR ART
FIG. 6A is a cross-sectional view of an electrical connector of the prior art No. 1 used in the test of which results are shown in Table 1.

A vibration test of the electrical connectors according to the invention and of the prior art No. 1 and No. 2 will be explained. The test was carried out under conditions of vibrations of frequencies of 20 to 200 Hz, an acceleration of 10 G, and testing time of 15 min/cycle, and time periods from start to instantaneous interruption were measured. The results are shown in Table 1. The operation of an electrical connector of prior art No. 1 shown in FIG. 6A ended only after one hour from starting, and the operation of an electrical connector of prior art No. 2 shown in FIG. 6B ended after four hours from starting. In contrast herewith, the normal operation of the electrical connector according to the invention persisted for more than ten hours which indicates the improved resistance to vibration according to the invention.

TABLE 1

| | Testing Time (hour) | | | | | | | | | |
|---|---|---|---|---|---|---|---|---|---|---|
| | 1 | 2 | 3 | 4 | 5 | 6 | 7 | 8 | 9 | 10 |
| Prior Art No. 1 | ○ | × | × | × | × | × | × | × | × | × |
| Prior Art No. 2 | ○ | ○ | ○ | ○ | × | × | × | × | × | × |
| Invention | ○ | ○ | ○ | ○ | ○ | ○ | ○ | ○ | ○ | ○ |

Figure 1B:
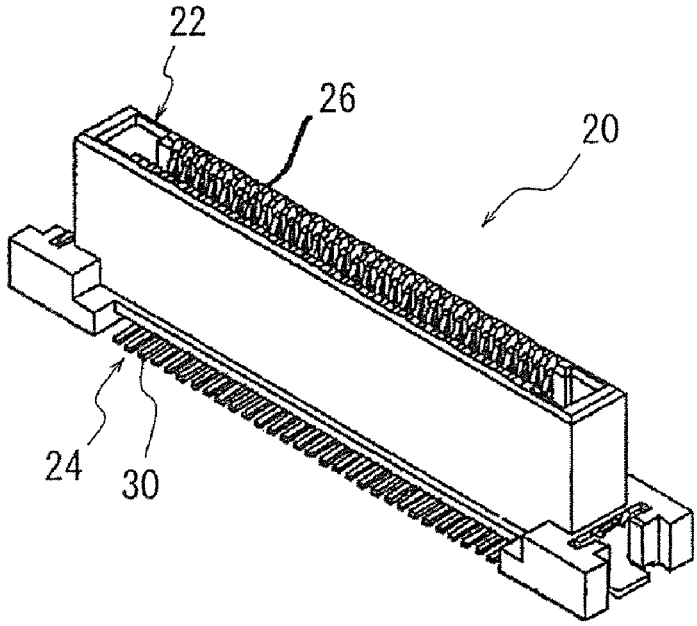
FIG. 1B is a perspective view of the receptacle connector of the electrical connector according to the invention viewed from the side of fitting with the plug connector.
Figure 2:
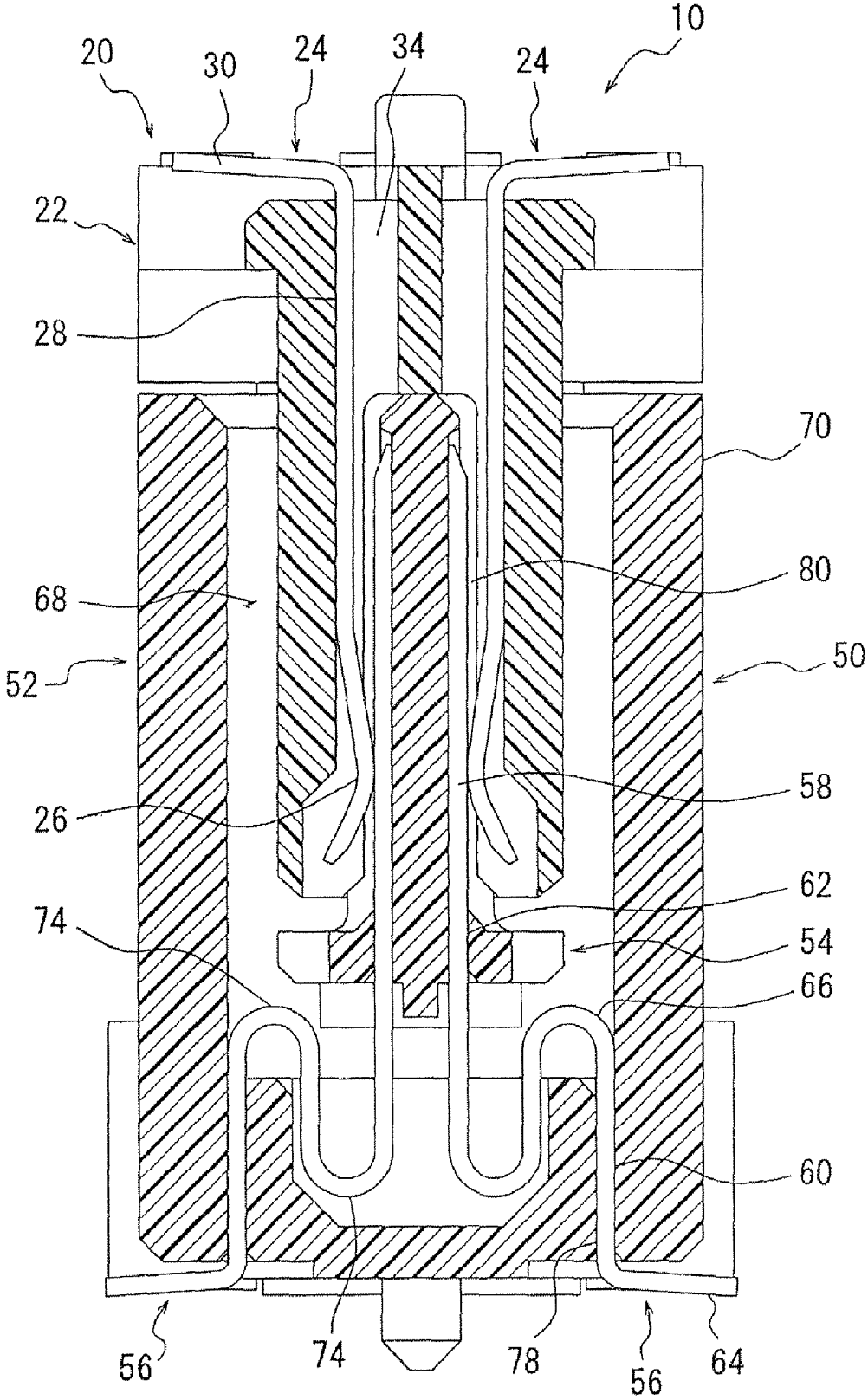
FIG. 2 is a cross-sectional view of the plug and receptacle connectors fitted with each other taken along contacts.
Figure 3A:
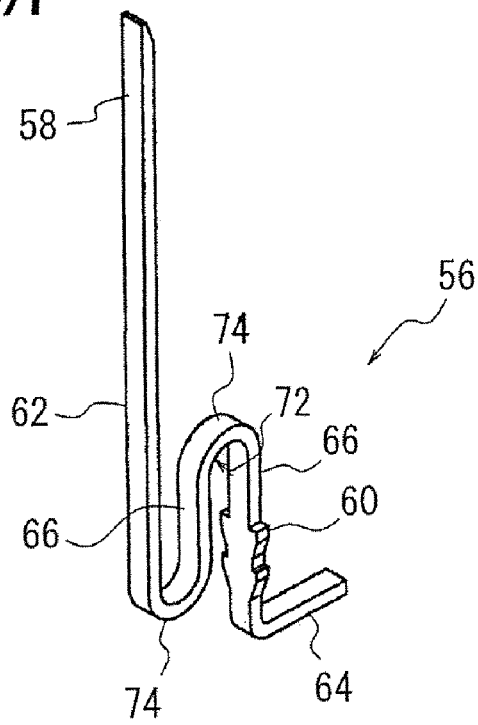
FIG. 3A is a perspective view of a plug contact used in the plug connector.
Figure 3B:
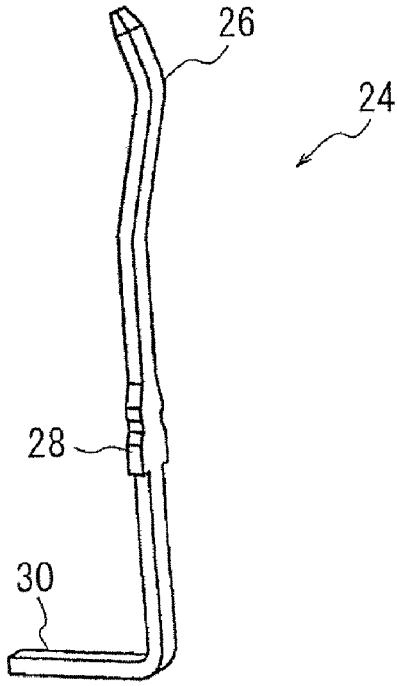
FIG. 3B is a perspective view of a receptacle contact used in the receptacle connector.
Figure 4A:
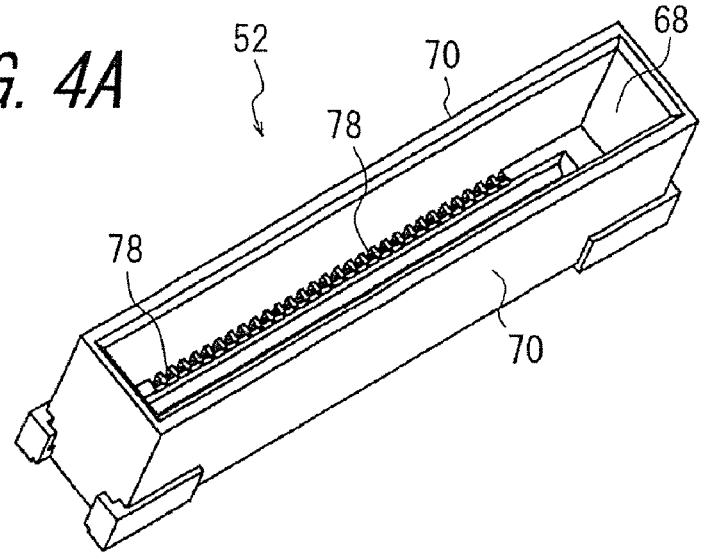
FIG. 4A is a perspective view of a housing of the plug connector.
Figure 4B:
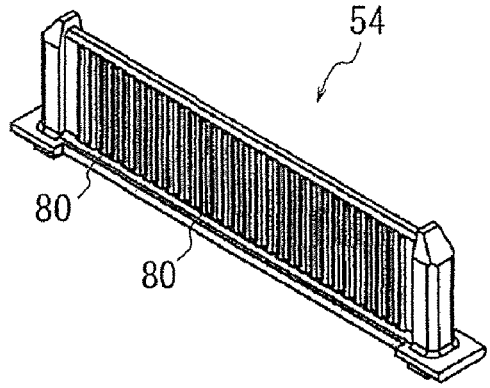
FIG. 4B is a perspective view of an insulator of the plug connector.
Figure 4C:
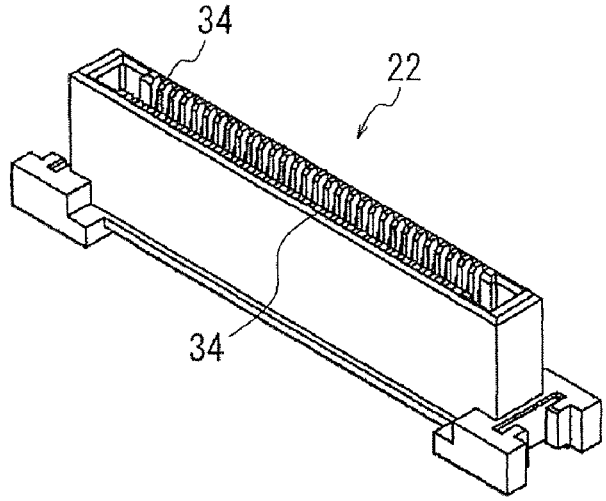
FIG. 4C is a perspective view of a block of the receptacle connector.
Figure 5A:
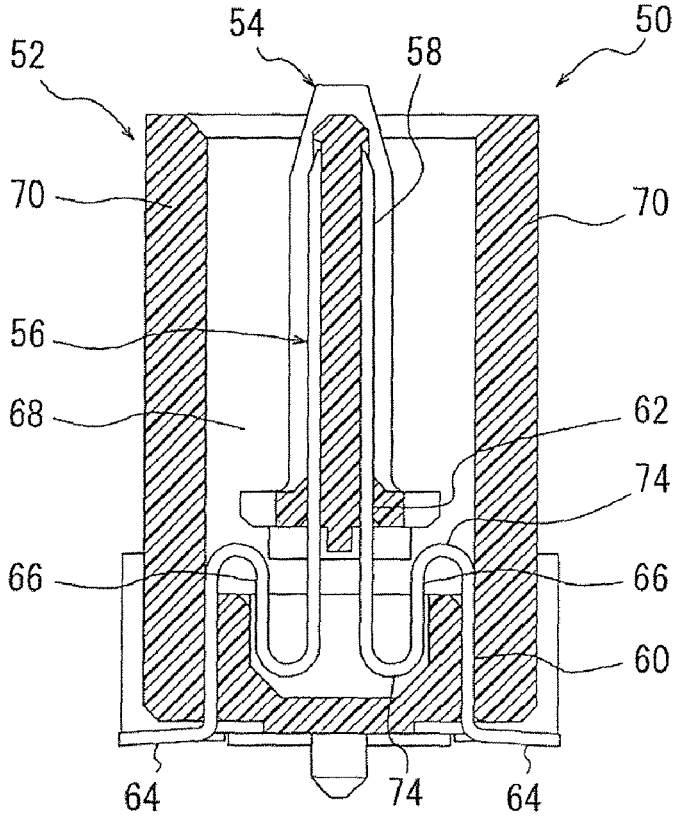
FIG. 5A is a cross-sectional view of the plug connector taken along the contacts.
Figure 5B:
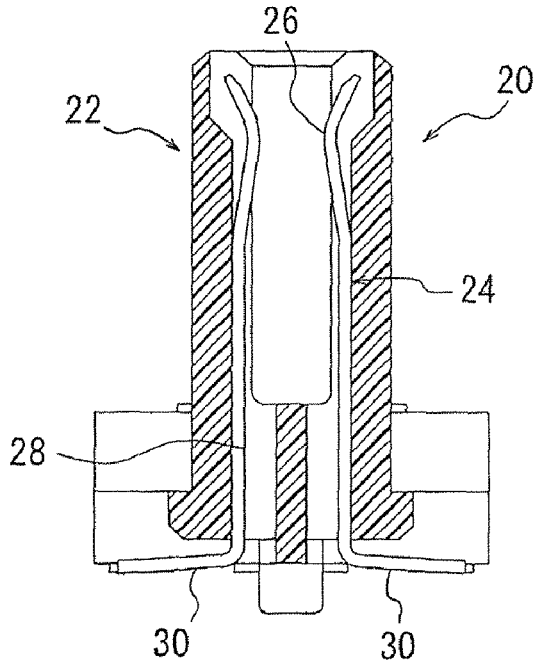
FIG. 5B is a cross-sectional view of the receptacle connector taken along the contacts.

One embodiment of the electrical connector will be explained with reference to the drawings. FIG. 1A is a perspective view of a plug connector viewed from the side of fitting with a receptacle connector, and FIG. 1B is a perspective view of the receptacle connector viewed from the side of the fitting with the plug connector. FIG. 2 is a cross-sectional view of the plug and receptacle connectors fitted with each other taken along contacts. FIG. 3A is a perspective view of a plug contact, while FIG. 3B is a perspective view of a receptacle contact. FIG. 4A is a perspective view of a housing of the plug connector, and FIG. 4B is a perspective view of an insulator of the plug connector, while FIG. 4C is a perspective view of a block of the receptacle connector. FIG. 5A is a cross-sectional view of the plug connector taken along contacts, and FIG. 5B is a cross-sectional view of the receptacle connector taken along contacts.

The electrical connector 10 according to the invention comprises a plug connector 50 and a receptacle connector 20. Each of the plug and receptacle connectors mainly comprises contacts 56 or 24 and insulators or an insulator of a plastic.

First, the plug connector 50 will be explained. The plug connector 50 mainly comprises a housing 52, an insulator 54, and plug contacts 56. Said housing 52 and said insulator 54 are formed from an electrically insulating plastic material by means of the injection molding of the known technique. The materials for the housing 52 and the insulator 54 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like and combination thereof. The housing 52 is formed with second inserting holes 78, and the insulator 54 is formed with third inserting holes 80 for installing a required number of the plug contacts 56 which are fixed thereto by press-fitting, hooking (lancing), welding or the like.

The plug contacts 56 will be explained which form an important aspect of the invention. Said plug contacts 56 are made of a metal and formed by means of the press-working of the known technique. Preferred metals from which to form said plug contacts 56 include brass, beryllium copper, phosphor bronze and the like which comply with the requirements as to springiness, electric conductivity, and the like. The plug contact 56 mainly comprises a second contact portion 58 adapted to contact the receptacle contact 24, a second fixed portion 60 to be fixed to said housing 52, a third fixed portion 62 to be fixed to said insulator 54, a second connection portion 64 to be connected to a substrate 90, and an elastic portion 66 provided between said second and third fixed portions 60 and 62 and being snaked or curved at least one location.

These respective portions of the plug contact 56 are arranged in the order of the second contact portion 58, the third fixed portion 62, the elastic portion 66, the second fixed portion 60, and the second connection portion 64. The respective portions will be explained hereafter. First, the second contact portion 58 is adapted to contact the first contact portion 26 of the receptacle contact 24. The second contact portion 58 is substantially in the form of a flat plate piece which contacts a first contact portion 26 of the receptacle contact 24 in a line contact at one location. The second contact portion 58 need only be able to contact the first contact portion 26 of said receptacle contact 24 and may be suitably designed in consideration of contact stability, space saving and a reduced overall height of the electrical connector 10 upon being fitted, workability and the like.

Said second fixed portion 60 is adapted to be held one of the second inserting holes 78 of the housing 52. The second fixed portion 60 is held by press-fitting it into the inserting hole 78 in the illustrated embodiment, but any holding methods may be employed insofar as the second fixed portion 60 can be firmly held in the inserting hole 78 and may be suitably designed taking into account a miniaturization of the connector, strength, holding force and the like.

Said elastic portion 66 serves to hold said insulator 54 in a floating state or to be movable (floating). The elastic portion 66 has one snaked or tortuous portion at one location in the illustrated embodiment. Said elastic portion 66 is arranged between said second fixed portion 60 and said third fixed portion 62 and further within the range from a position below said second contact portion 58 (on the side of the second connection portion 64) to a position below said insulator 54 (on the side of the second connection portion 64). The number of the snaked portion may be arbitrary so long as said insulator 54 can move (enables the floating), but may be suitably designed in consideration of space-saving and reduced overall height of the fitted electrical connector 10, workability, and the like. The radius 72 of curvature of the snaked portion may be suitably designed taking into account the space-saving and reduced overall height of the fitted electrical connector 10, workability, and the like. The radius of curvature is 0.2 to 0.7 mm in the illustrated embodiment. If it is less than 0.2 mm, the elasticity of the curved portions becomes insufficient to permit the floating, while if it is more than 0.7 mm, the space-saving of the fitted electrical connector 10 could not be achieved.

Said third fixed portion 62 of the plug contact 56 is adapted to be held in the third inserting hole 80 of said insulator 54. The third fixed portions 62 are held in the inserting holes 80, respectively, by press-fitting in the illustrated embodiment. However, any holding methods may be employed insofar as the third fixed portion 62 can be held in the insulator 54, and the holding for the plug contacts 56 may be suitably designed in consideration of the miniaturization of the connector, strength, the holding force, floating faculty of the insulator, and the like.

Said second connection portion 64 of the plug contact 56 is adapted to be connected to a substrate 90. The shape (or type) of the second connection portions 64 is of a surface mounting type (SMT) in the illustrated embodiment, but the shape is arbitrary so long as it can be connected to the substrate, for example, it may be a dip type. Moreover, said second connection portions 64 are arranged so as not to extend from said housing 52 taking into account the space-saving.

Considering the space-saving when fitted, it is preferable to provide a curved portion 74 between the third fixed portion and the elastic portion of said plug contact 56, is folded or curved inwardly (onto opposite side of said side wall). By providing the curved portion 74, a sufficient floating is ensured and space-saving is effectively achieved.

Said housing 52 will then be explained. Said housing 52 has a substantially U-shaped cross-section and is formed with the second inserting holes 78 whose number corresponds to the number of the plug contacts 56 for inserting and holding them therein. The shape and size of the second inserting holes 78 may be suitably designed in consideration of the size and shape of said plug contacts and holding force for the plug contacts.

Further, said housing 52 is formed with a space 68 for inserting said insulator 54 to be floating. The shape and size of said space 68 are arbitrary insofar as said space enables said insulator 54 to be received therein to permit floating of the insulator 54. The space 68 is larger of the order of 0.3 mm to 1.0 mm than said insulator 54 in consideration of the amount of floating of the insulator 54.

Said insulator 54 will then be explained. Said insulator 54 has a substantially T-shaped cross-section. The insulator 54 is formed with the third inserting holes 80 whose number corresponds to the number of said plug contacts 56 for inserting and holding the plug contacts therein. The shape and size of said third inserting holes 80 may be suitably designed taking into account the size and shape of said plug contacts and holding force for the plug contacts 56. Further, the third inserting holes 80 are so shaped as to cause the first contact portions 26 of said receptacle contacts 24 to contact the second contact portions 58 of said plug contacts 56, respectively.

The receptacle connector 20 will then be explained. Said receptacle connector 20 mainly comprises a block 22 and the receptacle contacts 24.

First, the receptacle contacts 24 will be explained. Said receptacle contacts 24 are made of a metal and formed by means of the press-working of the known technique. Preferred metals from which to form said receptacle contacts 24 include brass, beryllium copper, phosphor bronze and the like which comply with the requirements as to springiness, electric conductivity, and the like. Said receptacle contact 24 mainly comprises a first contact portion 26 adapted to contact the plug contact 56, a first fixed portion 28 to be fixed to said block 22, and a first connection portion 30 to be connected to a substrate 90.

The respective portions of the receptacle contact 24 are arranged in the order of the first contact portion 26, the first fixed portion 28, and the first connection portion 30. The respective portions will be explained hereafter. First, the first contact portion 26 is adapted to contact the second contact portion 58 of the plug contact 56. Said first contact portion 26 is substantially in the form of a bent plate piece which contacts the second contact portion 58 of the plug contact 56 in a line contact at one location. Said first contact portion 26 need only be able to contact the second contact portion 58 of said plug contact 56 and may be suitably designed in consideration of contact stability, space saving and reduced overall height of the electrical connector 10 upon being fitted, workability, and the like.

Said first fixed portion 28 is held in one of the first inserting holes 34 of said block 22. The first fixed portions 28 are held in the inserting holes 34 by press-fitting in the illustrated embodiment. Any holding methods may be employed so long as they are firmly held in the inserting holes and may be suitably designed taking into account the miniaturization of the connector, strength, holding force for the receptacle contacts, floating faculty of the insulator 54.

The first connection portion 30 is adapted to be connected to the substrate 90. The shape (or type) of the first connection portions 30 is of a surface mounting type (SMT) in the illustrated embodiment, but the shape (or type) is arbitrary insofar as it can be connected to the substrate 90, for example, it may be a dip type. Moreover, said first connection portions 30 are arranged so as not to extend from the block 22 in consideration of the space-saving.

Said block 22 will then be explained. The block 22 has a substantially T-shaped cross-section. The block 22 is formed from an electrically insulating plastic material by means of the injection molding of the known technique. The materials for the block 22 may be suitably selected in consideration of dimensional stability, workability, manufacturing cost, and the like and generally include polybutylene terephthalate (PBT), polyamide (66PA or 46PA), liquid crystal polymer (LCP), polycarbonate (PC), polyphenylene sulfide (PPS), and the like and combination thereof. Said block is formed with a required number of first inserting holes 34 for installing the receptacle contacts, respectively, by press-fitting, hooking (lancing), welding, or the like.

Examples of applications of the invention are electrical connectors for use in electric and electronic appliances for industrial machines, car navigation systems, and the like, and more particularly electrical connectors superior in resistance to vibration and enabling floating of a part in the connector even when a space-saving is achieved (width dimension in a fitted state being less than 5 mm).

While the invention has been particularly shown and described with reference to the preferred embodiments thereof, it will be understood by those skilled in the art that the foregoing and other changes in form and details can be made therein without departing from the spirit and scope of the invention.

What is claimed is:

1. An electrical connector consisting of a plug connector and a receptacle connector detachably fitted with each other, said receptacle connector including a plurality of receptacle contacts each having a first contact portion adapted to contact a mating contact, a first fixed portion to be fixed to a block, and a first connection portion to be connected to a substrate, and the block for arranging and holding said receptacle contacts, and said plug connector including a plurality of plug contacts each having a second contact portion adapted to contact said receptacle contact, second and third fixed portions to be fixed to a housing and an insulator, respectively, and a second connection portion to be connected to a substrate, and the housing and the insulator for arranging and holding said plug contacts, wherein each of said plug contacts is provided between said second and third fixed portions with an elastic portion having at least one snaked portion, and said insulator is held in a floating state in said housing by supporting the insulator only by said plug contacts, wherein the shape of the second contact portion of each of said plug contacts is substantially in the form of a plate-shaped piece, and further the second contact portion of each of said plug contacts and the first contact portion of each of said receptacle contacts are caused to contact each other in line contact at one location, and wherein said elastic portion of each of said plug contacts is arranged within a range from a position below said second contact portion on the side of the second connection portion to a position below said insulator on the side of the second connection portion.

2. The electrical connector as claimed in claim 1, wherein said housing is provided with a space substantially in the form of a box in which said receptacle connector is accommodated and said insulator is suspended to allow floating movement, and a width dimension of the fitted plug and receptacle connectors is limited to 5 mm or less even if thicknesses of side walls of said housing are made to be as thick as possible to achieve improvement in vibration proof characteristics, while allowing the floating suspension of the insulator.

3. The electrical connector as claimed in claim 1, wherein said elastic portion has only one snaked portion and two radii of curvatures are 0.2 to 0.7 mm.

4. The electrical connector as claimed in claim 1, wherein each of said plug contacts is provided between the elastic portion and the third fixed portion with a curved portion which is folded inwardly onto the opposite side of the side wall.

5. The electrical connector as claimed in claim 2, wherein said elastic portion has only one snaked portion and two radii of curvatures are 0.2 to 0.7 mm.

* * * * *